US007232128B2

(12) United States Patent
Laporte

(10) Patent No.: US 7,232,128 B2
(45) Date of Patent: Jun. 19, 2007

(54) FOOTBALL BOARD GAME

(76) Inventor: Jeffrey Laporte, 122 Mire Ct., Slidell, LA (US) 70458

( * ) Notice: Subject to any disclaimer, the term of this patent is extended or adjusted under 35 U.S.C. 154(b) by 1 day.

(21) Appl. No.: 11/089,144

(22) Filed: Mar. 24, 2005

(65) Prior Publication Data

US 2006/0214371 A1 Sep. 28, 2006

(51) Int. Cl.
*A63F 3/00* (2006.01)

(52) U.S. Cl. ..... 273/247; 273/259; 273/277

(58) Field of Classification Search ..... 373/247; 273/247, 244, 259, 277
See application file for complete search history.

(56) References Cited

U.S. PATENT DOCUMENTS 5,407,204 A * 4/1995 Meyer, III ..... 273/244.2
5,496,036 A * 3/1996 Chester ..... 273/247

* cited by examiner

*Primary Examiner*—Vishu K. Mendiratta
(74) *Attorney, Agent, or Firm*—Keaty Professional Law Corporation

(57) ABSTRACT

A board game simulating a football season is played by two or more players according to the general rules of the game of "Fantasy Football." The board game uses a game board with indicia thereon resembling a football field. A game path is formed on the game board, the game path being divided into spaces with instructions imprinted thereon directing a player to advance or retract when moving a game piece along the board according to chance means. The game uses several decks of cards, which are provided separately from the board with indicia thereon that represents actual players in actual teams that provide instructions to the game player of the manner of progression along the board, that keep weekly and seasonal scores for the teams.

15 Claims, 14 Drawing Sheets

TEAM #_____

| WEEK | POINTS | W / L |
|---|---|---|
| 1 | | / |
| 2 | | / |
| TOTAL | | |
| 3 | | / |
| TOTAL | | |
| 4 | | / |
| TOTAL | | |
| 5 | | / |
| TOTAL | | |
| 6 | | / |
| TOTAL | | |
| 7 | | / |
| TOTAL | | |
| 8 | | / |
| TOTAL | | |
| 9 | | / |
| TOTAL | | |
| 10 | | / |
| TOTAL | | |
| 11 | | / |
| TOTAL | | |
| 12 | | / |
| TOTAL | | |
| 13 | | / |
| TOTAL | | |
| 14 | | / |
| TOTAL | | / |
| SEASON CHIPS | | / |
| GRAND TOTAL | | / |

| WEEK | POINTS | W / L |
|---|---|---|
| 1 | | / |
| 2 | | / |
| TOTAL | | |
| 3 | | / |
| TOTAL | | |
| 4 | | / |
| TOTAL | | |
| 5 | | / |
| TOTAL | | |
| 6 | | / |
| TOTAL | | |
| 7 | | / |
| TOTAL | | |
| 8 | | / |
| TOTAL | | |
| 9 | | / |
| TOTAL | | |
| 10 | | / |
| TOTAL | | |
| 11 | | / |
| TOTAL | | |
| 12 | | / |
| TOTAL | | |
| 13 | | / |
| TOTAL | | |
| 14 | | / |
| TOTAL | | / |
| SEASON CHIPS | | / |
| GRAND TOTAL | | / |

| WEEK | POINTS | W / L |
|---|---|---|
| 1 | | / |
| 2 | | / |
| TOTAL | | |
| 3 | | / |
| TOTAL | | |
| 4 | | / |
| TOTAL | | |
| 5 | | / |
| TOTAL | | |
| 6 | | / |
| TOTAL | | |
| 7 | | / |
| TOTAL | | |
| 8 | | / |
| TOTAL | | |
| 9 | | / |
| TOTAL | | |
| 10 | | / |
| TOTAL | | |
| 11 | | / |
| TOTAL | | |
| 12 | | / |
| TOTAL | | |
| 13 | | / |
| TOTAL | | |
| 14 | | / |
| TOTAL | | / |
| SEASON CHIPS | | / |
| GRAND TOTAL | | / |

Fig. 2

26 TEAM # 28 24 30

WEEK # 1

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 2

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 3

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 4

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 5

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 6

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

ABBREVIATIONS

POS = POSITION
QB = QUATERBACK
WR = WIDE RECEIVER
RB = RUNNING BACK
TE = TIGHT END
K = KICKER
DEF = DEFENSE
BN = BENCH

WEEK # 7

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

Fig. 3

TEAM #_____

WEEK # 8

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 9

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 10

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 11

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 12

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 13

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

WEEK # 14

| POS. | PLAYER | PTS. |
|---|---|---|
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |
| WEEKLY CHIP COUNT | | |
| WEEKLY TOTAL | | * |

*Transfer Score to Sheet 1

Fig. 4

First Round of PLAYOFFS WEEK # 15

| FIRST - SEED TEAM # | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

VS.

| FOURTH - SEED TEAM # | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

| SECOND - SEED TEAM # | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

VS.

| THIRD - SEED TEAM # | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

Fig. 5

| WINNER OF GAME 1 WEEK #15 | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

40

VS.

| WINNER OF GAME 2 WEEK #15 | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

42

Fig. 6

| LOSER OF GAME 1 WEEK #15 | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

44

VS.

| LOSER OF GAME 2 WEEK #15 | | |
|---|---|---|
| Position | Player | Points |
| QB | | |
| WR | | |
| WR | | |
| RB | | |
| RB | | |
| TE | | |
| K | | |
| DEF | | |
| BN | | |
| BN | | |
| BN | | |
| BN | | |
| TOTAL | | |

46

| |
|---|
| CHAMPION:WINNER OF GAME 1 TEAM # |
| 2ND. PLACE:LOSER OF GAME 1 TEAM # |
| 3RD. PLACE:WINER OF GAME 2 TEAM # |
| 4TH. PLACE:LOSER OF GAME 2 TEAM # |

48

Fig. 7

INJURY LIST

| PLAYER'S NAME | TEAM # | WEEK AVAIL. |
|---|---|---|
| | | |

| PLAYER'S NAME | TEAM # | WEEK AVAIL. |
|---|---|---|
| | | |

Fig. 8

3 TEAMS

| WEEK | TEAMS | BYE |
|---|---|---|
| 1 | 1-2 | 3 |
| 2 | 2-3 | 1 |
| 3 | 1-3 | 2 |
| 4 | 1-2 | 3 |
| 5 | 2-3 | 1 |
| 6 | 1-3 | 2 |
| 7 | 1-2 | 3 |
| 8 | 2-3 | 1 |
| 9 | 1-3 | 2 |
| 10 | 1-2 | 3 |
| 11 | 2-3 | 1 |
| 12 | 1-3 | 2 |
| 13 | 1-2 | 3 |
| 14 | 2-3 | 1 |

4 TEAMS

| WEEK | TEAMS | |
|---|---|---|
| 1 | 1-2 | 3-4 |
| 2 | 1-3 | 2-4 |
| 3 | 1-4 | 2-3 |
| 4 | 1-2 | 3-4 |
| 5 | 1-3 | 2-4 |
| 6 | 1-4 | 2-3 |
| 7 | 1-2 | 3-4 |
| 8 | 1-3 | 2-4 |
| 9 | 1-4 | 2-3 |
| 10 | 1-2 | 3-4 |
| 11 | 1-3 | 2-4 |
| 12 | 1-4 | 2-3 |
| 13 | 1-2 | 3-4 |
| 14 | 1-3 | 2-4 |

5 TEAMS

| WEEK | TEAMS | | BYE |
|---|---|---|---|
| 1 | 1-2 | 3-4 | 5 |
| 2 | 1-3 | 2-5 | 4 |
| 3 | 1-4 | 3-5 | 2 |
| 4 | 1-5 | 2-4 | 3 |
| 5 | 2-3 | 4-5 | 1 |
| 6 | 1-2 | 3-4 | 5 |
| 7 | 1-3 | 2-5 | 4 |
| 8 | 1-4 | 3-5 | 2 |
| 9 | 1-5 | 2-4 | 3 |
| 10 | 2-3 | 4-5 | 1 |
| 11 | 1-2 | 3-4 | 5 |
| 12 | 1-3 | 2-5 | 4 |
| 13 | 1-4 | 3-5 | 2 |
| 14 | 2-3 | 2-4 | 3 |

6 TEAMS

| WEEK | TEAMS | | |
|---|---|---|---|
| 1 | 1-2 | 3-4 | 5-6 |
| 2 | 1-3 | 2-5 | 4-6 |
| 3 | 1-4 | 2-6 | 3-5 |
| 4 | 1-5 | 3-6 | 4-2 |
| 5 | 1-6 | 2-3 | 4-5 |
| 6 | 1-2 | 3-4 | 5-6 |
| 7 | 1-3 | 2-5 | 4-6 |
| 8 | 1-4 | 2-6 | 3-5 |
| 9 | 1-5 | 3-6 | 4-2 |
| 10 | 1-6 | 2-3 | 4-5 |
| 11 | 1-2 | 3-4 | 5-6 |
| 12 | 1-3 | 2-5 | 4-6 |
| 13 | 1-4 | 2-6 | 3-5 |
| 14 | 1-5 | 3-6 | 4-2 |

7 TEAMS

| WEEK | TEAMS | | | BYE |
|---|---|---|---|---|
| 1 | 1-2 | 3-4 | 5-6 | 7 |
| 2 | 1-3 | 2-4 | 5-7 | 6 |
| 3 | 1-4 | 2-3 | 6-7 | 5 |
| 4 | 1-5 | 2-6 | 3-7 | 4 |
| 5 | 1-6 | 2-5 | 4-7 | 3 |
| 6 | 1-7 | 3-5 | 4-6 | 2 |
| 7 | 2-7 | 3-6 | 4-5 | 1 |
| 8 | 1-2 | 3-4 | 5-6 | 7 |
| 9 | 1-3 | 2-4 | 5-7 | 6 |
| 10 | 1-4 | 2-3 | 6-7 | 5 |
| 11 | 1-5 | 2-6 | 3-7 | 4 |
| 12 | 1-6 | 2-5 | 4-7 | 3 |
| 13 | 1-7 | 3-5 | 4-6 | 2 |
| 14 | 2-7 | 3-6 | 4-5 | 1 |

8 TEAMS

| WEEK | TEAMS | | | |
|---|---|---|---|---|
| 1 | 1-2 | 3-4 | 5-6 | 7-8 |
| 2 | 1-3 | 2-4 | 5-7 | 6-8 |
| 3 | 1-4 | 2-3 | 5-8 | 6-7 |
| 4 | 1-5 | 2-6 | 3-7 | 4-8 |
| 5 | 1-6 | 2-7 | 3-8 | 4-5 |
| 6 | 1-7 | 2-8 | 3-5 | 4-6 |
| 7 | 1-8 | 2-5 | 3-6 | 4-7 |
| 8 | 1-2 | 3-4 | 5-6 | 7-8 |
| 9 | 1-3 | 2-4 | 5-7 | 6-8 |
| 10 | 1-4 | 2-3 | 5-8 | 6-7 |
| 11 | 1-5 | 2-6 | 3-7 | 4-8 |
| 12 | 1-6 | 2-7 | 3-8 | 4-5 |
| 13 | 1-7 | 2-8 | 3-5 | 4-6 |
| 14 | 1-8 | 2-5 | 3-6 | 4-7 |

9 TEAMS

| WEEK | TEAMS | | | | BYE |
|---|---|---|---|---|---|
| 1 | 1-2 | 3-4 | 5-6 | 7-8 | 9 |
| 2 | 1-3 | 2-4 | 5-7 | 6-9 | 8 |
| 3 | 1-4 | 2-3 | 5-9 | 6-8 | 7 |
| 4 | 1-5 | 2-9 | 3-7 | 4-8 | 6 |
| 5 | 1-6 | 2-7 | 3-8 | 4-9 | 5 |
| 6 | 1-7 | 2-6 | 3-5 | 9-8 | 4 |
| 7 | 1-8 | 2-5 | 9-7 | 4-6 | 3 |
| 8 | 1-9 | 3-6 | 4-7 | 5-8 | 2 |
| 9 | 2-8 | 3-9 | 4-5 | 6-7 | 1 |
| 10 | 1-2 | 3-4 | 5-6 | 7-8 | 9 |
| 11 | 1-3 | 2-4 | 5-7 | 6-9 | 8 |
| 12 | 1-4 | 2-3 | 5-9 | 6-8 | 7 |
| 13 | 1-5 | 2-9 | 3-7 | 4-8 | 6 |
| 14 | 1-6 | 2-7 | 3-8 | 4-9 | 5 |

Fig. 17

10 TEAMS

| WEEK | TEAMS | | | | |
|---|---|---|---|---|---|
| 1 | 1-2 | 3-4 | 5-6 | 7-8 | 9-10 |
| 2 | 1-8 | 3-5 | 4-10 | 7-6 | 9-2 |
| 3 | 1-6 | 3-7 | 4-5 | 9-8 | 10-2 |
| 4 | 1-3 | 4-7 | 5-10 | 9-6 | 2-8 |
| 5 | 1-4 | 3-9 | 5-7 | 7-6 | 8-10 |
| 6 | 1-5 | 3-2 | 4-9 | 7-10 | 8-6 |
| 7 | 1-7 | 3-8 | 4-2 | 5-9 | 6-10 |
| 8 | 1-10 | 3-6 | 4-8 | 5-2 | 7-9 |
| 9 | 1-9 | 3-10 | 4-6 | 5-8 | 7-2 |
| 10 | 1-2 | 3-4 | 5-6 | 7-8 | 9-10 |
| 11 | 1-8 | 3-5 | 4-10 | 7-6 | 9-2 |
| 12 | 1-6 | 3-7 | 4-5 | 9-8 | 10-2 |
| 13 | 1-3 | 4-7 | 5-10 | 9-6 | 2-8 |
| 14 | 1-4 | 3-9 | 5-7 | 7-6 | 8-10 |

11 TEAMS

| WEEK | TEAMS | | | | | BYE |
|---|---|---|---|---|---|---|
| 1 | 1-2 | 3-4 | 5-6 | 7-8 | 9-10 | 11 |
| 2 | 1-3 | 2-4 | 10-7 | 6-8 | 9-11 | 5 |
| 3 | 1-4 | 2-3 | 5-8 | 6-7 | 10-11 | 9 |
| 4 | 1-5 | 2-6 | 3-9 | 4-10 | 7-11 | 8 |
| 5 | 1-6 | 2-5 | 3-10 | 4-9 | 8-11 | 7 |
| 6 | 1-10 | 2-8 | 3-5 | 4-4 | 7-9 | 6 |
| 7 | 1-8 | 2-7 | 6-9 | 4-5 | 3-4 | 10 |
| 8 | 1-9 | 2-10 | 3-8 | 6-4 | 5-7 | 4 |
| 9 | 1-7 | 2-9 | 5-4 | 8-10 | 6-4 | 3 |
| 10 | 1-11 | 3-7 | 5-9 | 8-4 | 6-10 | 2 |
| 11 | 2-11 | 4-7 | 5-10 | 8-9 | 6-3 | 1 |
| 12 | 1-2 | 3-4 | 5-6 | 7-8 | 9-10 | 11 |
| 13 | 1-3 | 2-4 | 10-7 | 6-8 | 9-11 | 5 |
| 14 | 1-4 | 2-3 | 5-8 | 6-7 | 10-11 | 9 |

12 TEAMS

| WEEK | TEAMS | | | | | |
|---|---|---|---|---|---|---|
| 1 | 1-2 | 3-4 | 5-6 | 7-8 | 9-10 | 11-12 |
| 2 | 1-3 | 2-4 | 5-7 | 6-8 | 9-11 | 10-12 |
| 3 | 1-4 | 2-3 | 5-8 | 6-7 | 9-12 | 10-11 |
| 4 | 1-5 | 2-6 | 3-9 | 4-10 | 7-11 | 8-12 |
| 5 | 1-6 | 2-5 | 3-10 | 4-9 | 7-12 | 8-11 |
| 6 | 1-7 | 2-8 | 3-11 | 4-12 | 5-9 | 6-10 |
| 7 | 1-8 | 2-7 | 3-12 | 4-11 | 5-10 | 6-9 |
| 8 | 1-9 | 2-10 | 5-11 | 6-12 | 7-3 | 8-4 |
| 9 | 1-10 | 2-9 | 5-12 | 6-11 | 7-4 | 8-3 |
| 10 | 1-11 | 2-12 | 3-5 | 4-6 | 7-9 | 8-10 |
| 11 | 1-12 | 2-11 | 3-6 | 4-5 | 7-10 | 8-9 |
| 12 | 1-2 | 3-4 | 5-6 | 7-8 | 9-10 | 11-12 |
| 13 | 1-3 | 2-4 | 5-7 | 6-8 | 9-11 | 10-12 |
| 14 | 1-4 | 2-3 | 5-8 | 6-7 | 9-12 | 10-11 |

Fig. 18

FOOTBALL BOARD GAME

BACKGROUND OF THE INVENTION

This invention relates generally to board games that have its origins in sporting events, such as professional football games. More particularly, the present invention relates to a board game, which has a rolling dice, a plurality of playing pieces with indicia thereon, as well as score cards.

There are numerous sport board games, which correspond to sporting events, such as football, basketball and the like. Some board games are played by 2 persons, while others are more regularly played by three or more persons. Many board games employ a playing board in combination with playing cards, with a board defining a path along which a player moves upon rolling of the dice. The players are required to draw cards from a deck of randomly arranged cards and move a playing piece according to the instructions of the space wherein the player's playing piece has landed. It is noted that games give a player an opportunity to exhibit the player's knowledge of the game, while other games are purely games of chance, with little of no skill required to win the game.

The so-called "Fantasy Football" game has been developed for playing on the Internet between players who agree to follow a specific set of rules. Each league's members draft national football league players to be on their team and receive point based on their drafted players performance each week of the season.

The present invention contemplates provision of a board game that has its basis in and utilizes terminology of professional football and its rules and combines the features of a game of chance and some features of a skill game.

SUMMARY OF THE INVENTION

It is, therefore, an object of the present invention to provide a board game that can be played by two or more people using the decks of specially imprinted cards corresponding to the terminology of American football.

It is another object of the present invention to provide a board game, which can be played by rolling of the die for advancing the playing piece of the player around the board game.

These and other objects of the present invention are achieved through a provision of a board game, which simulates the game of "Fantasy Football." According to the rules of the game, a first deck of cards is provided with indicia thereon representative of actual football players and their respective scores during a previous playing season. The indicia also includes indication of the actual player's position in a team, such as quarterback, wide receiver, running back, defense tight end, kicker and bench. A chance means, such as dice, is provided for selecting the first game player that is afforded a chance to compose the game player's team by drafting desired players from the first deck of cards. As a result, the first player has an opportunity to choose his "dream team" with the highest score, which will be added to the score during the game.

Once all game players built their teams, the game is progressed according to the instructions on the game board and corresponding first plurality of playing cards. The game board has indicia thereon resembling a football field and a designated path divided into a plurality of spaces, each containing instructions for advancing along the designated path. The instructions contain indicia simulating real situations in a football game, such as "You May Switch 1 Player with Free Agency Pile," "Propose a Trade," and the like. Some of the spaces have indicia directing a game player to "Pick Pile," which will cause the game player to pick a card from the first plurality of the "Pick Pile" deck of cards. The points can be added or lost as the player follows the game board and the playing cards instructions. The game is played simulating the weekly games, progressing to playoffs, with the player securing the highest score advancing to the finals.

The board game further comprises a second plurality of decks of cards, which are used for recording the score during the "weekly" plays. The score is kept for every team and each week. The board game further comprises a plurality of tokens, which, depending on the roll of the dice, direct the players to add or subtract point during progression of the game. Some of the instructions on the game board and the instruction cards instruct a particular game player to be excluded from the game due to an imaginary injury. The missing players cause the game player to lose a designated number of points. The board game may be played by two or more players, repeating weekly plays and season plays indefinitely.

The instant board game provides for the use of a deck of cards with statistics from the players' previous season or from a deck of cards projecting what their statistics will be in the next season. The game players can play the instant game, which covers the entire season, as opposed to a weekly game as is possible with the Internet-based game.

BRIEF DESCRIPTION OF THE DRAWINGS

Reference will now be made to the drawings, wherein like parts are designated by like numerals, and wherein

FIG. 2 is a plan view of the individual score sheet for the season issued to each player.

FIG. 3 is a plan view of the individual score sheets and weekly rosters to be filled in by an individual payer for every week for Weeks 1 through 7.

FIG. 4 is a plan view of the individual score sheets and weekly rosters for playing during Weeks 8 through 14.

FIG. 5 is a plan view of a playoff score sheet for Week #15.

FIG. 6 is a plan view of a playoff score sheet for Championship Round Week #16.

FIG. 7 is a plan view of a player score sheet of the Consolation Round Week #16.

FIG. 8 is a plan view of "Injured Players" tables to be filled in by the board game players.

FIG. 17 is a plan view of a weekly schedule formula for a number of playing teams.

FIG. 18 is a plan view of exemplary score keeping cards when playing the board game of the present invention based on the weekly schedule formula.

DETAIL DESCRIPTION OF THE PREFERRED EMBODIMENT

Figure 1:
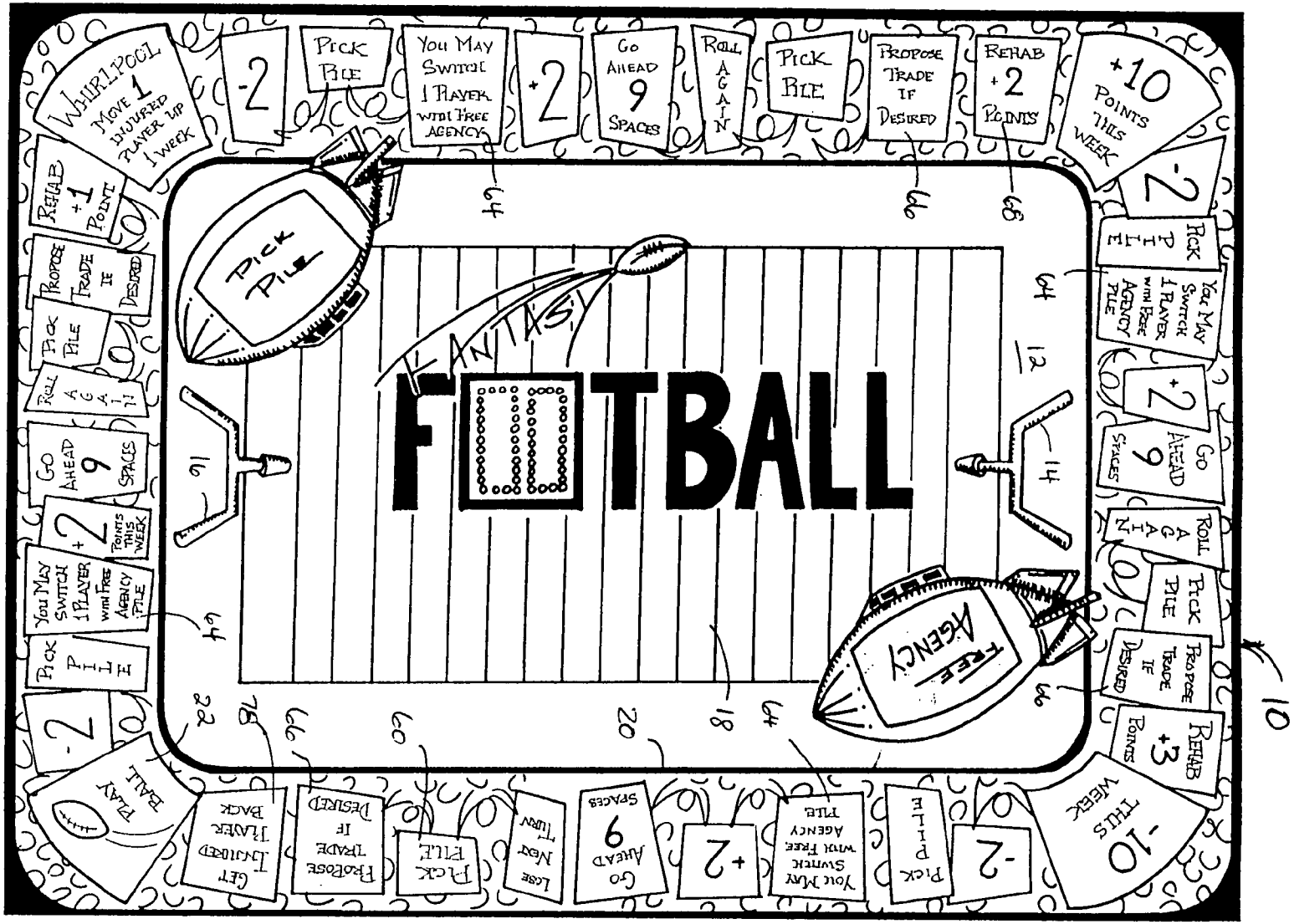
FIG. 1 is a plan view of the board game in accordance with the present invention.

Turning now to the drawings in more detail, numeral 10 designates a game board of the present invention with indicia imprinted thereon. The board game has a top planar surface, which simulates a football playing field. The central area 12 of the game board 10 simulates a football field with goals 14 and 16 schematically shown on the board. The central area 12 may have yard lines indicia 18 imprinted thereon, as well as the word "football" in the center of the board. An area surrounding the central area 12 of the game board 10 has indicia thereon representing "stadium seats" occupied by spectators schematically designated by numeral 20 in the drawings. The spectators hold up a plurality of signs, or game playing spaces, which form a game path for moving along the board 10.

Some of the instructions on the playing spaces allow a player to proceed a designated number of spaces, other instructions require the players to pick a card from the pile, still others instruct the player to "Roll Again," "You May Switch One Player with the Free Agency Pile," "Play Ball", and the like.

The board game is played between two or more opponents, using the below-described rules. To start, team tokens are sorted to correspond to the number of players in the game. The tokens are placed face down and then selected by each player. The number a player receives in the draft order (if using serpentine draft) becomes the order for the first roll. In the serpentine draft, the player drafts from the smallest number to the largest number for odd number draft rounds and from largest number to the smallest number for even number rounds. For instance, round one is number 1–12, the number 12 player would then draft first in the second round and then go into the descending order until number one player drafts. In round three, number one player would go first again.

The game is then played starting with week number one. In the first week, each player, starting with team number one rolls the dice and follows the directions on the board. The other team follows along the board path. Week one is considered over when the first person lands on or crosses the Play Ball" square schematically illustrated in FIG. 1 and designated by numeral 22.

The subsequent weeks 2–14 are played substantially identically, that is the first person that crosses the "play ball" square 22 of week 1 and every week thereafter, starts first during the next week, followed by team numbers in sequence. The playoff weeks number 14 and 15 each start with the lowest number team left and follow in sequence of team numbers. The progress of the play is documented and recorded on the score sheets shown in FIG. 2 for each individual team.

At the start of each week, each team must select their starting roster for that week and fill it in on the individual score/team roster sheet before the first person rolls the dice. At the end of each week, starting with the first week and ending with week 14, the players collect weekly chips and use them to adjust the weekly score. The weekly number is written in the box next to the weekly chip count for the corresponding week on the individual score/roster sheet (FIG. 2). At the same time, a score is kept for the player's cards for the corresponding week, wherein the points for each player are written next to the name of the individual score/team roster sheet shown in FIG. 3. All players add their score based on the individual players; they also keep the score, with the total score point being printed next to the weekly total line. In the individual score sheets and weekly rosters, a score is kept for each player for the week.

As shown in FIG. 3, an exemplary card 24 contains several columns: the first column 26 corresponds to a position of the player; the central column 28 corresponds to the particular player, while the third column 30 corresponds to the points earned by the player during that week. Additionally, the position of the player is designated in abbreviated fashion, common to professional team players' position. More specifically, "QB" corresponds to quarterback, "WR" corresponds to wide receiver, "RB" correspond to running back, "TE" corresponds to tight end, "K" corresponds to kicker, "DEF" corresponds to a defense player, and "BN" corresponds to a bench. The total of the points is entered in column 3, added with the weekly chip count and the weekly total, and the resultant score is transferred to the week points score card shown in FIG. 2. The individual score cards of FIG. 2 also contain three columns. The first column corresponds to a particular week/league score.

After the player scores and points have been added and entered into the total box, the player looks at the weekly schedule sheet to see which players will participate in the next week's plays. If the score of player number 1 is higher than team that player number 1 will be facing, the first player gets a win for the week. The score is entered and the total of the individual score for the season sheet is generated based on the scores of the cards shown in FIG. 2. At the end of weeks 1–14, the players collect their season point chips.

At the end of week 14, the season points of the individual score sheets for the season are added up, then the season point sheets are added and placed in the corresponding box on one of the cards shown in FIG. 2. The top four teams advance to playoffs. The total points in the playoffs are only used to break ties.

At the end of playoff week number 15, the weekly sheets do not count. The lowest team number throws the dice first and then is followed in sequence of team numbers. A playoff score sheet for week number 15, shown in FIG. 5, is used to keep the scores. As can be seen in FIG. 5, the scorecard is divided into three columns for each seed team number. The first column corresponds to the player position, the central column corresponds to the player, and the last column corresponds to the points earned during the game. Two winning teams play for championship, and two losing teams play for the $3^{rd}$ and the $4^{th}$ place.

The scorecards for week 16 are schematically shown in FIG. 6 wherein the winner of game 1 for week number 15 and the winner of game 2 for week 15 are played against each other. The scorecard for the championship week number 16 is similarly divided into three columns designating the position, the player and the points earned by each particular player on the team. The total numbers are calculated and entered into the scorecards 40 and 42. The winner of the championship game during week 16 is the champion and the loser receives second place in the game. The winner of the consolation game is the third person and the loser takes the $4^{th}$ place. The consolation round week is played at the end of playoff week 16 and the score is tabulated in the cards 44 and 46. The final placement of the teams is entered in the card 48 shown in FIG. 7.

Figure 9:
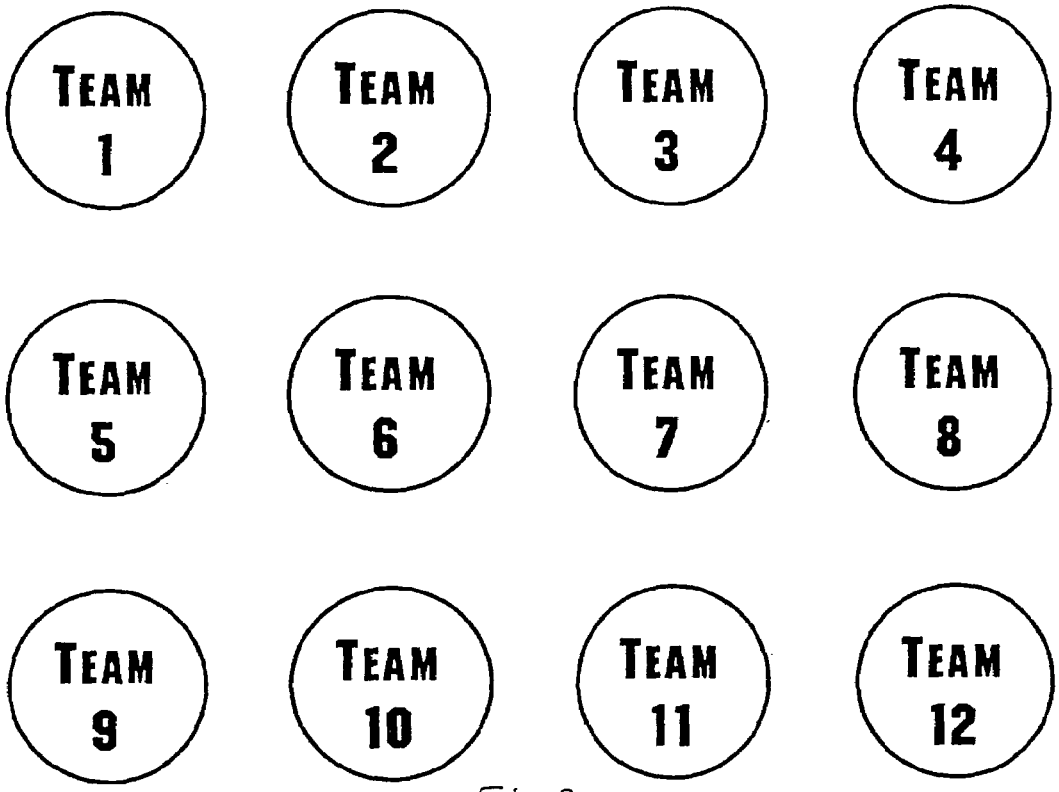
FIG. 9 is a plan view of playing tokens for teams 1 through 12.
Figure 10:
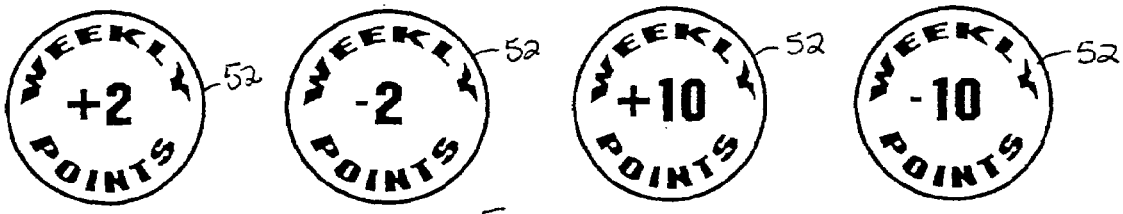
FIG. 10 is a plan view of weekly point tokens.
Figure 11:
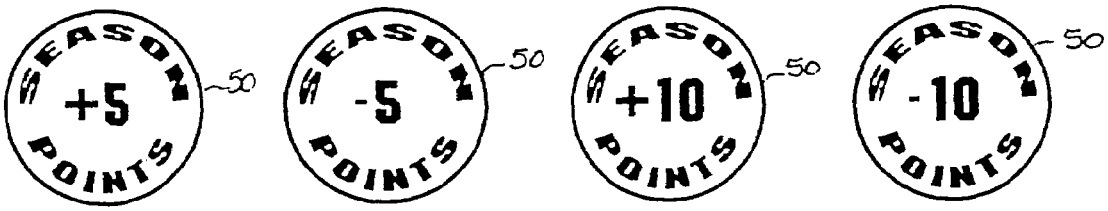
FIG. 11 is a plan view of season point tokens.

While the game is played, a number of playing pieces are used for advancing the players around the game board. Season chips are used to adjust season total scores after week 14 has ended. These chips are not used during playoff weeks. Weekly chips are used to adjust the score at the end of each week and are not used during playoff weeks. A free agent pile corresponds to the players left after the draft or players that are dropped by the game player during the season. The season point tokens or season chips are schematically shown in FIG. 11 and designated by numeral 50 in the drawings. These chips allow adding or subtracting between 5 and 10 season points. The weekly points chips or tokens are schematically shown in FIG. 10 and designated by numeral 52. These tokens allow to adjust the score between adding or subtracting 2 and 10 points. The player tokens for teams 1 through 12 are schematically illustrated in FIG. 9 and designated by numeral 54 in the drawings. The playing tokens have indicia thereon corresponding to the team numbers.

Figure 12:
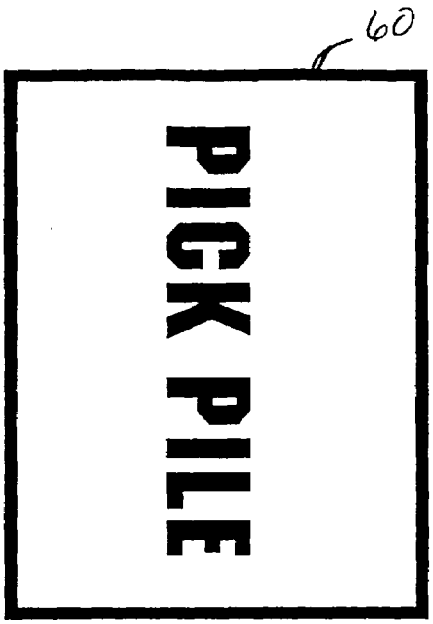
FIG. 12 is a plan view of a "pick pile" cards.
Figure 13:
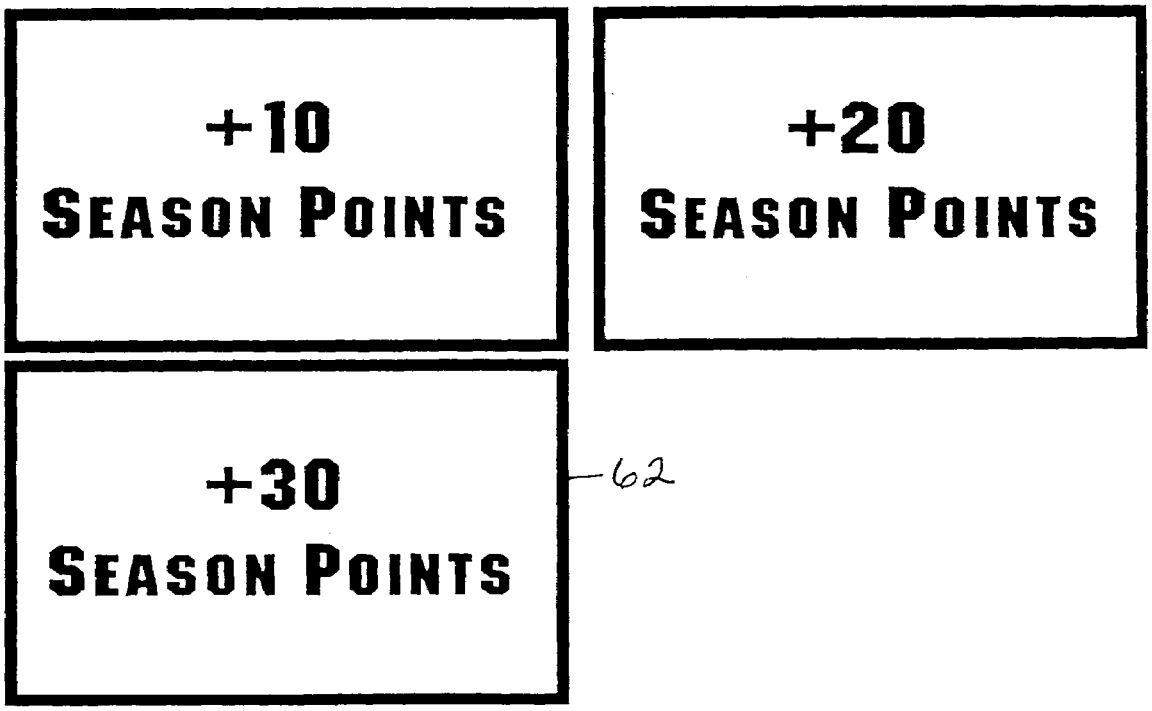
FIG. 13 is a plan view of a "season points" cards.

The board game of the present invention further provides for the use of "Pick Pile" deck of cards shown in FIGS. 12 and 13 in the drawings. The cards of FIG. 12, designated by numeral 60 and the cards of FIG. 13, designated by numeral 62, are part of the "Pick Pile" deck of cards. These cards are shuffled and placed face down. They are shuffled each time the last card is taken. The player progresses along the game board following the directions on the card, such as "Pick Pile," "Add 10 season points," "Add 20 season points," and "Add 30 season points".

According to the rules of the game, the game player may switch the "Free Agent" pile. If the game player playing piece lands on the space, designated by numeral 64 in FIG. 1, the game player may chose a player from the team of players and switch with one from the "Free Agent" pile. If the game player lands on one of the spaces designated by numeral 66 in FIG. 1, the game player is allowed to propose a trade with another team. This step may involve multiple players or one player. If the trade is accepted, it must be approved by at least two other game players, if there are four or more players in the game. If there are three persons playing the game, the trade must be approved by the third game player.

Figure 11A:
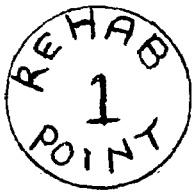
FIG. 11*a* is a plan view of "Rehab points" token.

The players also accumulate points for their "bye" weeks. After the game player reaches 5 "Rehab" points, that game player can trade the points in to get an injured player from the team off the injured list. The rehab players' position is illustrated in FIG. 1 and is designated by numeral 68. Some of the positions allow to add 3 "Rehab" points, while other rehab positions allow to add 1 "Rehab" point to the total score. "Rehab" tokens as shown in FIG. 11*a* are given to the game player that lands on the "Rehab" position.

Figure 15:
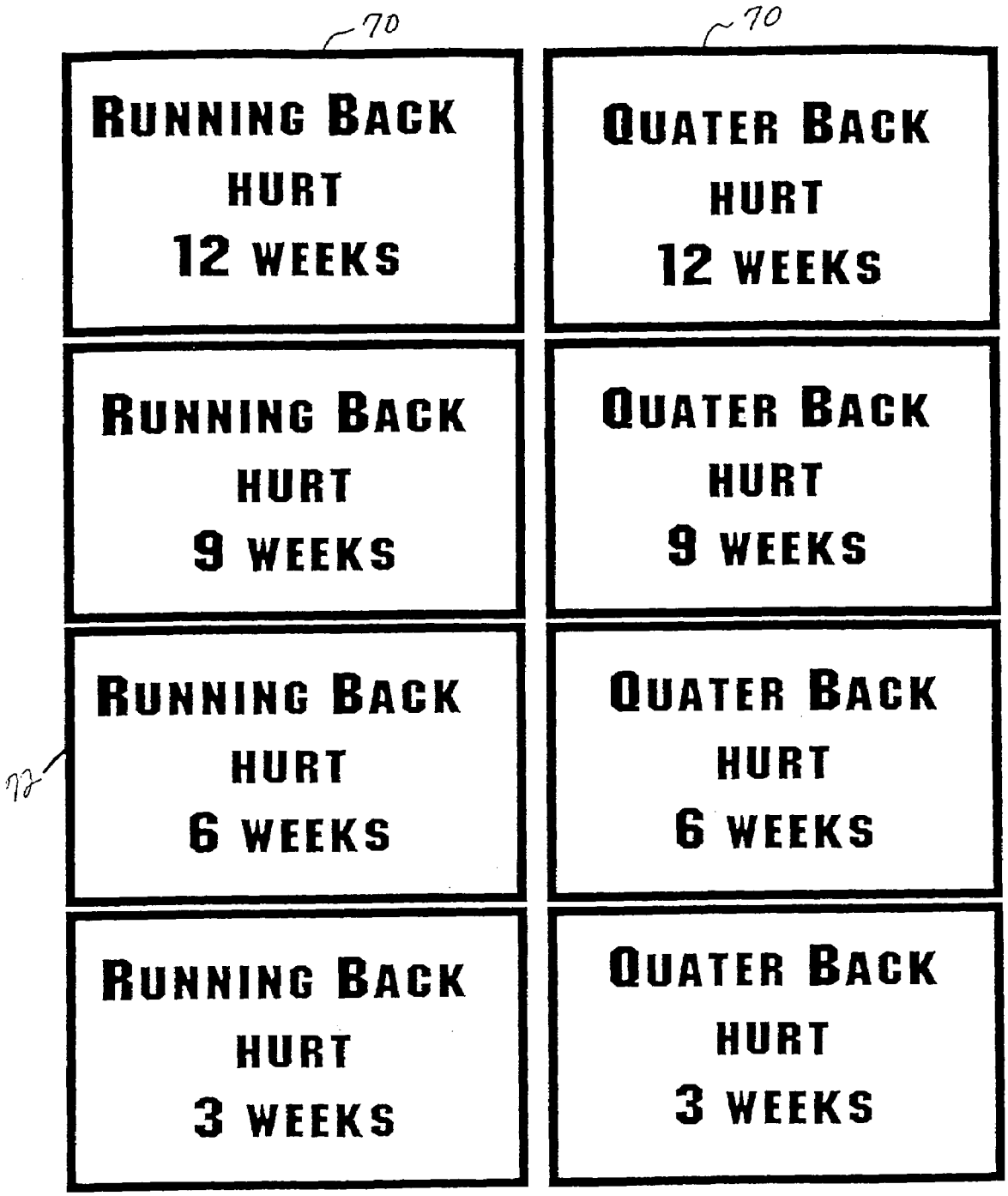
FIG. 15 is a plan view of the playing cards with directions for moving a playing piece around the board.
Figure 15A:
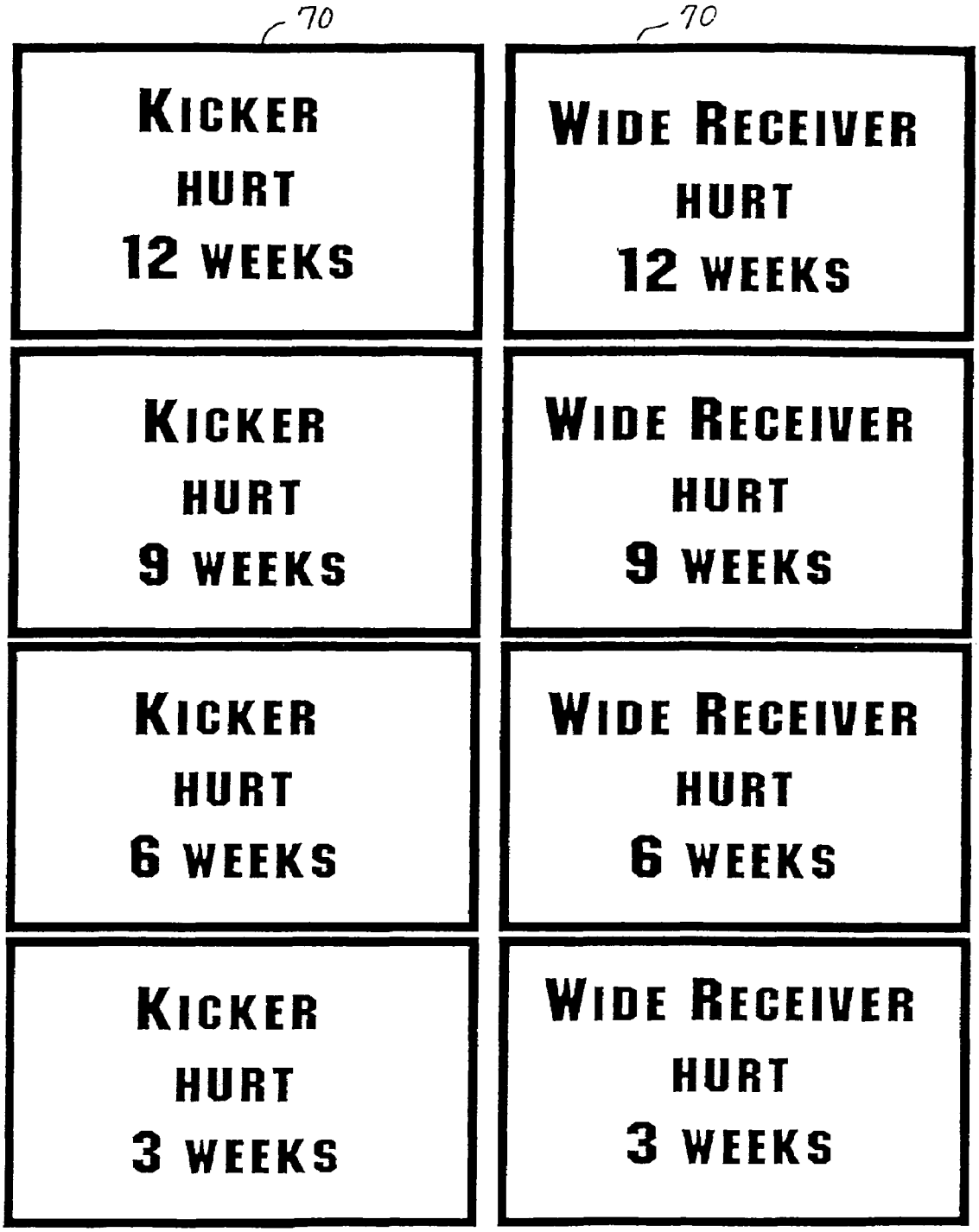
FIG. 15*a* is a plan view of a plurality of instruction playing cards for moving the playing piece along the board.

Still another feature of the present invention is the "injured player card". These cards are illustrated in FIGS. 8, 15 and 15*a* of the drawings. The injured player cards 70 in FIGS. 15 and 15*a* show a number of steps for the game players. For instance, if a game player No. 1 picks this card, the game player with the next lowest numbered teams blindly picks the player from the team of player No. 1, who would be considered symbolically "injured." If team No. 1 picks this card, the highest number team blindly picks the player who would be considered "injured." The status of the "injured player" suspends the "injured" player for a period of time between a few weeks to 12 weeks, depending on the particular card drawn by the game player. The team with the "injured player" takes all the players on its team at that position and holds them up, while allowing the team with the next lowest score to pick a player. For instance, a player may be designated as "injured" in week 3 and will remain injured for 6 weeks if card number 72 is picked. The "injured" player will become available in week 3 but not in weeks 4 through 9, making the "injured" player again available in week number 10. If the "injured" player is dropped from the team, the "injured" player becomes a "free" agent. However, the "injured" player remains on the injured players' list until the injury period as set on the play card 72 is over.

Figure 16:
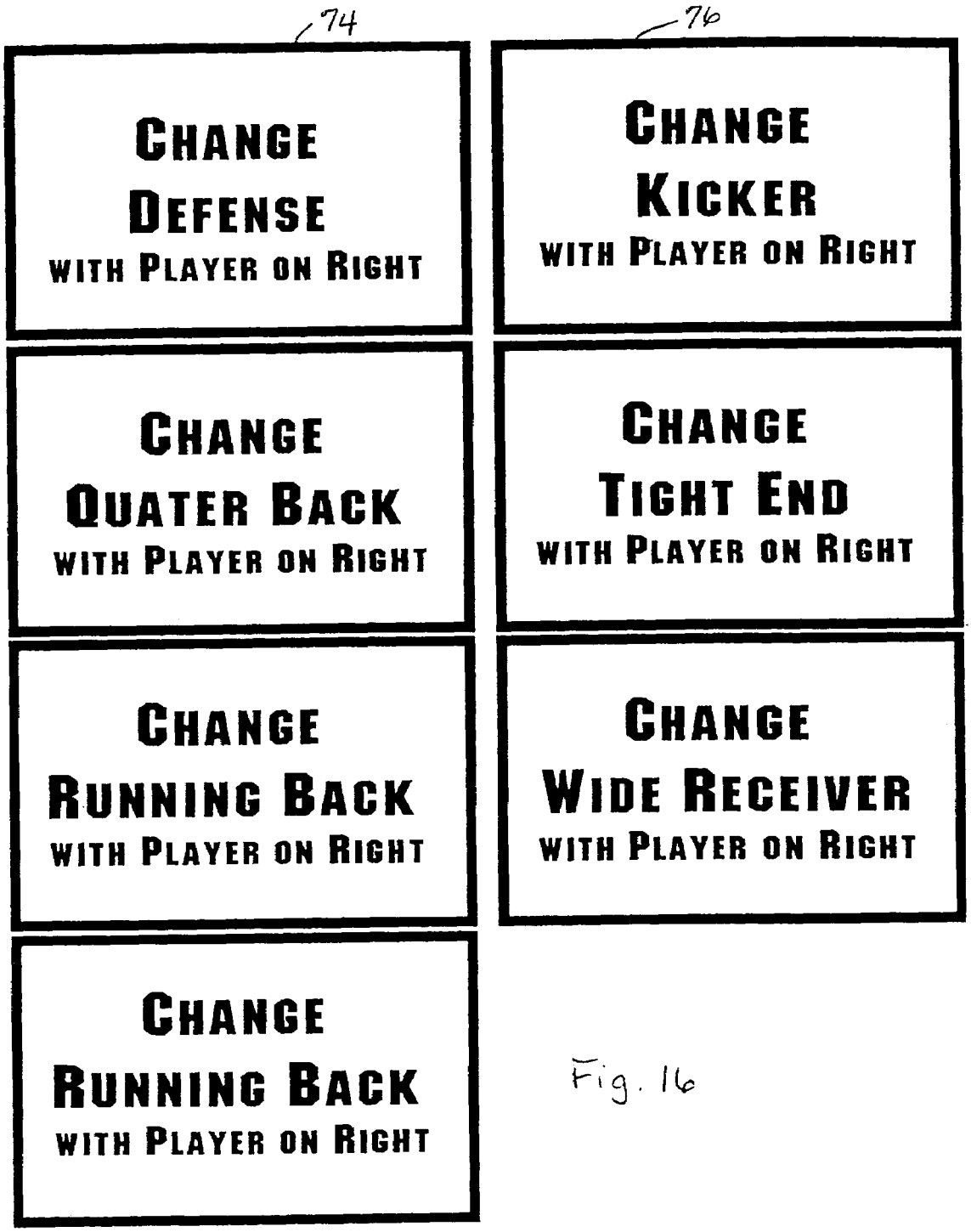
FIG. 16 is a plan view of additional playing cards with directions preprinted thereon.

The cards of the present invention also allow the game participants to choose players depending on the instructions given on the card. For instance, as shown in FIG. 16, card designated by numeral 74 allows the game participant to change defense with player on right. The card designated by numeral 76 in FIG. 16 allows the game participant to change a kicker with the player on the right. Similarly, the game participant may change quarterbacks, running backs, and wide receivers depending on the particular card drawn by the game participant. If the game participant draws this card, the game player must switch with the next lower numbered team. This step is conducted as a blind draw by both teams. Each team holds all their players in that position up and the other game player draws. If team number one draws a card, they switch with the highest numbered team. If the game participant lands on game space 78 it allows the game participant to get the injured player back.

FIGS. 17 and 18 illustrate the manner in which the score is kept for three to twelve teams playing each week. According to the rules of this board game, teams with "Bye weeks" still accumulate points. The weekly schedule formula is recorded in the play sheets for weeks 1 through 14 and the scores are kept for every week, from week 1 to week 14. At the end of week 14, the four teams with the most points will to go to the playoffs, as was described above. The points are used to break a tie. If one or more teams in odd numbered leagues (3, 5, 7, 9, 11,) have played less games due to having more "bye weeks" it presents no difference to the progression of the game. Still the four teams that accumulated the most score win. For instance, a score of 7:5 becomes No. 2, score of 7:4 becomes No. 5. Team No. 2 and team No. 5 would be tied and would have to consider the earned points to break the tie. The team with more "bye" weeks is at a disadvantage. Therefore, it is preferred that the game is played with an even number of teams.

The present invention provides for the play tokens shown in FIG. 9 to be shuffled and picked for draft order and playing the game. The weekly point tokens shown in FIG. 10 are received by landing on a corresponding space on the game board. The season point tokens shown in FIG. 11 are received when picking a corresponding card from the "Pick Pile." The "Pick Pile" contains a deck of cards with different instructions for the game participants re-enacting progression of the player according to the instructions on the card.

Figure 14:
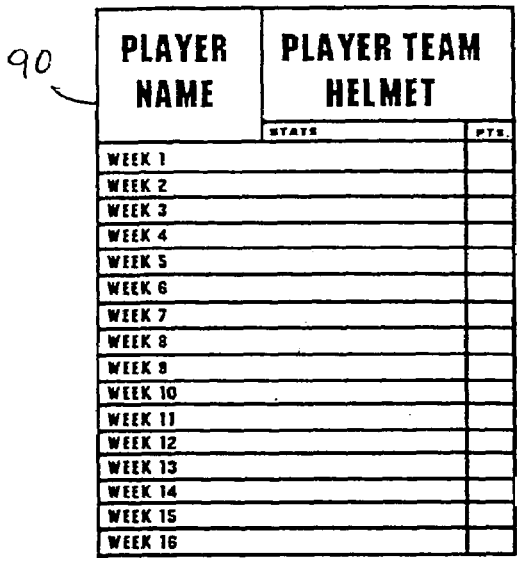
FIG. 14 is a plan view of a playing piece with a particular player name to be used on the card.

The player cards shown in FIG. 14 and designated by numeral 90 in the drawings correspond to current football players in their previous season's statistics, broken down into 16 weeks with corresponding points. It is envisioned that the player and the helmet number and the player's name will be incorporated in the card 90. The player cards may be based on the actual players participating in the National Football League games, provided suitable agreements are reached with the league-licensing agency.

It is envisioned that the game can be easily adapted for playing other games, such as Fantasy basketball, Fantasy soccer, Fantasy hockey, etc. The instructions on the playing cards and the board can be changed to simulate rules of the respective games.

Many other changes and modifications may be made in the game of the present invention without departing from the spirit thereof. I, therefore, pray that my rights to the present invention be limited only by the scope of the appended claims.

I claim:

1. A method of playing a simulated football game, comprising the following steps:

identifying a selected number of prededermined actual football players and their respective position in actual football teams;

identifying score points achieved by the selected football players during a previous playing season;

providing a game board having indicia thereon including instructions for advancing along a designated path along the game board;

providing a first deck of cards, each card comprising indicia thereon representative of the selected football players, score points achieved by the selected football players during a previous playing season and the selected football players' respective position in actual teams;

providing a chance means for randomly determining an order of selection of cards from the first deck of cards by two or more game players;

providing a first plurality of deck of cards for recording a game score, each of said first plurality of deck of cards comprising indicia thereon representing a weekly score of a team during a playing season;

providing a second plurality of deck of cards, each of said second plurality of deck of cards comprising indicia thereon representing instructions for advancing along the designated path on the game board, which correspond to instructions on the game board;

providing a plurality of game tokens, said tokens comprising a first set of tokens having indicia representing team numbers, a second set of tokens having indicia representing weekly point scores and a third set of tokens having indicia representing season point scores;

beginning a play by using the chance means;

identifying a first game player with the highest chance means score and allowing said first game player to pick selected cards from the first deck of cards representative of actual football players;

allowing the first game player to form a play team group represented by the selected cards from the first deck of cards;

using the chance means to determine for all game players selected cards from the first deck of cards representing football players for their respective play team groups;

using the chance means to advance game players along the game board, while following instructions for advancing along the game board imprinted on the game board and the second plurality of the deck of cards;

creating a record of play points as simulated scores for weekly and season plays and declaring a winner based on the highest score of play points achieved at the end of a playoffs week.

2. The method of claim 1, wherein instructions of the second plurality of the deck of cards simulate conventional rules of the game of football.

3. The method of claim 1, wherein the cards in the first deck of cards represent actual players in different football teams.

4. The method of claim 1, wherein said game board has a generally planar top surface, with further indicia imprinted thereon which is simulative of a football field.

5. The method of claim 1, further comprising a step of providing game pieces for advancing a number of spaces along the designated path according to said chance means.

6. The method of claim 1, wherein instructions on the game board comprise indicia representing addition and deduction of score points corresponding to the indicia contained in the second plurality of deck of cards.

7. The method of claim 1, further comprising a step of providing a plurality of score indicators for indicating the score and status of the team during a playing season.

8. The method of claim 1, further comprising a step of providing a set of rules for the game.

9. The board game of claim 1, further comprising a plurality of game pieces for advancing a number of spaces along the designated path according to said chance means.

10. A board game apparatus that simulates a real football season, comprising:

a game board comprising indicia thereon including instructions for advancing along a designated path along the game board;

a first deck of cards comprising indicia thereon representative of actual football players, score points achieved by the actual football players during a previous playing season and actual football players' respective position in actual teams;

a chance means for randomly determining an order of selection of cards from the first deck of cards by two or more game players;

a first plurality of deck of cards for recording a game score, each of said plurality of the deck of cards being representative of a weekly score during a playing season;

a first set of game tokens comprising indicia thereon representing play team numbers;

a second set of game tokens comprising indicia thereon representing weekly point scores;

a third set of game tokens comprising indicia thereon representing season point scores; a plurality of score indicators for indicating the score and status of the actual team during a playing season; and a second plurality of deck of cards having indicia thereon representative of instructions for advancing along the designated path on the game board, which correspond to instructions on the game board.

11. The board game of claim 10, wherein said instructions contained in the second plurality of the deck of cards simulate conventional rules of the game of football.

12. The board game of claim 10, wherein said indicia contained in the first deck of cards represents actual players in different football teams.

13. The board game of claim 10, wherein said game board has a generally planar top surface, with further indicia imprinted thereon which is simulative of a football field.

14. The board game of claim 10, wherein instructions on the game board comprise indicia representing addition and deduction of score points corresponding to the indicia contained in the second plurality of deck of cards.

15. The board game of claim 10, wherein the decks of cards, game pieces and tokens are positioned separately from the game board.

* * * * *